United States Patent [19]

Craft

[11] Patent Number: 4,925,223

[45] Date of Patent: May 15, 1990

[54] CAP BRACE FOR HARDWOOD CASKETS

[75] Inventor: William K. Craft, North Bend, Ohio

[73] Assignee: Batesville Casket Company, Inc., Batesville, Ind.

[21] Appl. No.: 339,207

[22] Filed: Apr. 13, 1989

[51] Int. Cl.[5] ..... E05C 17/24

[52] U.S. Cl. ..... 292/339; 292/265

[58] Field of Search ..... 292/338, 339, 262, 265, 292/266, 267; 217/60 C; 27/18

[56] References Cited

U.S. PATENT DOCUMENTS

| | | | |
|---|---|---|---|
| 265,275 | 10/1882 | Olinger | 292/265 |
| 706,960 | 8/1902 | Koegel | 27/18 |
| 1,755,063 | 4/1930 | Holden | 217/60 C |
| 3,060,546 | 10/1962 | Nelson | 27/18 |
| 3,959,859 | 6/1976 | Stein, Jr. et al. | 27/18 |
| 4,360,953 | 11/1982 | Angermann | 27/18 |
| 4,588,220 | 5/1986 | Matsui et al. | 292/338 |

FOREIGN PATENT DOCUMENTS

| | | | |
|---|---|---|---|
| 506874 | 6/1939 | United Kingdom | 292/38 |

*Primary Examiner*—Richard E. Moore

*Attorney, Agent, or Firm*—Wood, Herron & Evans

[57] ABSTRACT

A brace for wooden casket cap. A channel slot is routed in the top edge of the body of the casket. A plastic channel is inserted in the slot. The channel is secured in the slot by transverse fore and aft nails. A brace is pivoted to the cap and slidable in the channel. A hook on the end of the brace is captured by the aft nail to hold the brace and cap in the open position.

4 Claims, 2 Drawing Sheets

CAP BRACE FOR HARDWOOD CASKETS

BACKGROUND OF THE INVENTION

This invention relates to a brace for a casket cap and particularly a brace for a wooden casket cap.

In a wooden casket, the cap is hinged to the casket body. The cap must be raised and held in raised position from time to time. A collapsible brace is needed for that purpose.

The problem with a hardwood casket insofar as the mounting of a brace is concerned is that the flat finished edge of the hardwood cap rests on the flat finished edge of the casket body and there is no convenient place for a brace. A conventional over-the-center knee brace has been used. The knee brace is pivoted at one end to the inside of the cap wall. The cap liner must be punctured to accommodate that end of the brace. At the other end, the brace is pivoted to the inside of the body wall. It is necessary to work the upholstery around that pivot point. After installation, there is, from time to time, the possibility of the knee brace getting hung up on the upholstery and actually tearing the upholstery when the cap is raised.

SUMMARY OF THE INVENTION

It has been an objective of the present invention to provide a brace for a hardwood casket which is mounted out of the way of the cap headliner and upholstery and requires no disturbance of the headliner or upholstery for the installation or operation.

This objective of the invention is attained by providing a nesting of the brace in the upper edge of the casket body so that the two ends of the brace are mounted with respect to the casket without any interference with the headliner or upholstery. More specifically, a channel slot is formed in the upwardly-facing edge of the casket body. A plastic channel is inserted into that slot and held in position by nails passing into the wall of the casket at the front and rear of the channel. A brace is pivoted at its cap end to a bracket on the cap and is slidable at its body end in the channel in the upper edge of the body. The slidable end has a hook that is engageable with the rear transverse nail to hold the brace and casket cap in the raised position. The bracket on the cap nests in the plastic channel when the cap is closed upon the body.

Another feature of the invention has been to confine the end of the brace in the channel so that it does not pop out inadvertently. To this end, the channel has longitudinal inwardly-directed flanges that create an inner section or raceway. A follower is mounted on the slidable end of the brace and that follower slides in the inner section of the channel under the flanges, the flanges being spaced apart to create a slot sufficiently wide for the brace to slide along it but narrow enough to confine the laterally-projecting follower to the inner section of the channel.

The follower is a button having a pin projecting from it, the pin being inserted into a hole in the slidable end of the brace at the time of assembly. The flanges at the front end of the channel are discontinued to provide a small opening through which the follower can slide in the initial assembly of the brace to the channel.

BRIEF DESCRIPTION OF THE DRAWINGS

The several features and objectives of the present invention will become more readily apparent from the following detailed description taken in conjunction with accompanying drawings in which.

DETAILED DESCRIPTION OF THE INVENTION

Figure 1:
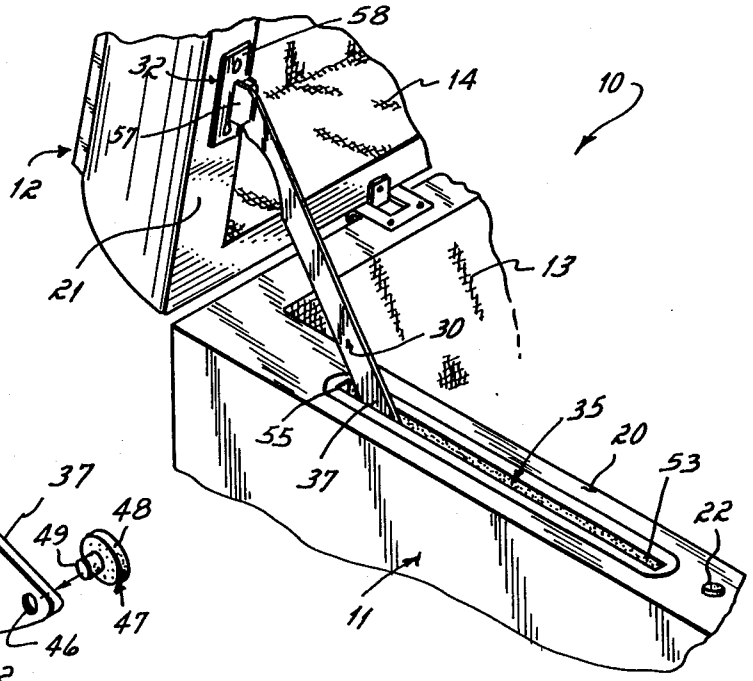
FIG. 1 a fragmentary perspective view of a casket employing the present invention.

Referring to the drawings, a casket 10 has a body 11 and a cap 12. The body has upholstery 13 in its interior and the cap has a headliner 14. Both cap and casket are hardwood and present finished edges 20 and 21, respectively, that lie against one another separated only by ⅛ inch rubber bumpers 22 when the cap is closed upon the body 11. A brace 30 has a cap end 31 that is pivotally mounted on a bracket 32 fixed to the edge 21 of the cap. It can be seen that the bracket is spaced from the headliner 14 and presents no interference to the headliner.

A plastic channel 35 is inserted into a channel slot 36 routed in the upper edge 20 of the casket body. The brace 30 has a body end 37 that is slidable in the plastic channel 35 and is adapted to be latched in the channel in the position shown in FIG. 1 to hold the cap in a raised or open position as shown.

Figure 2:
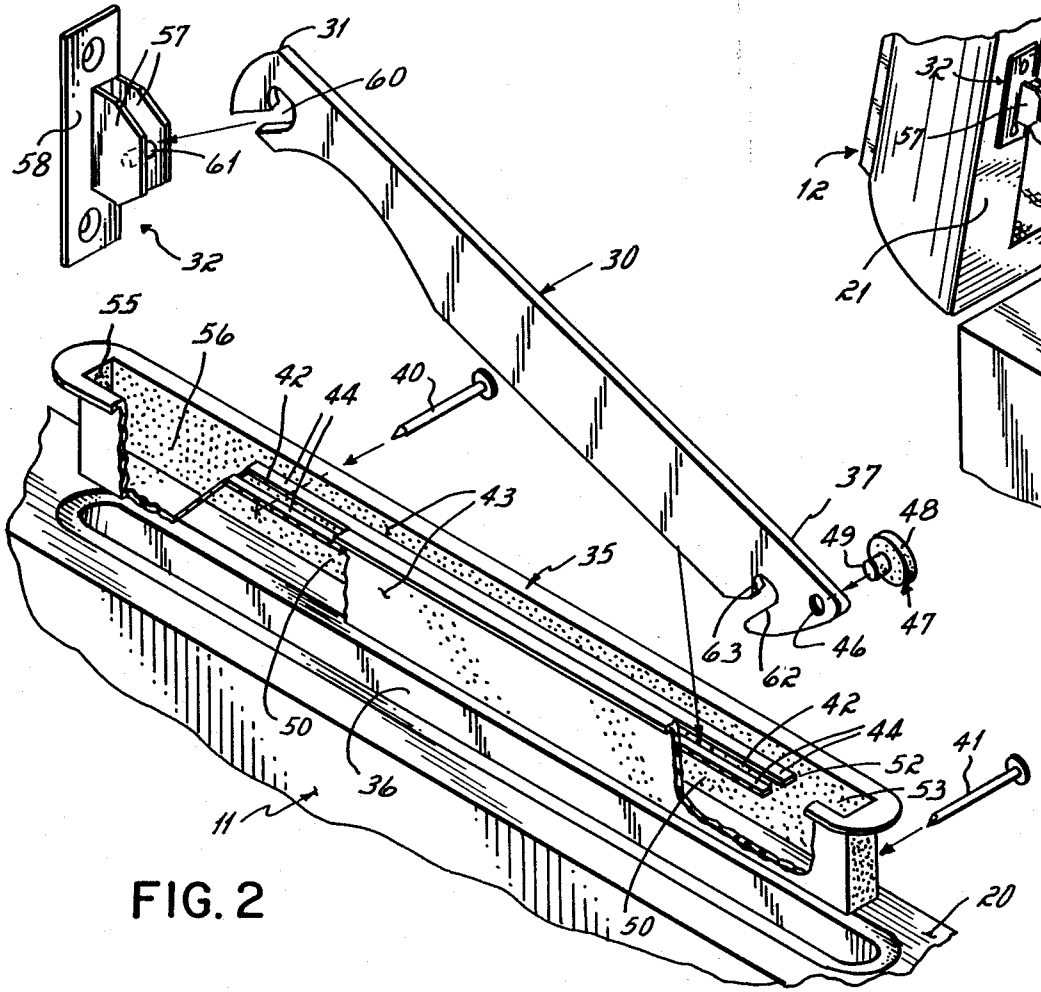
FIG. 2 is a disassembled perspective view of the brace assembly.
Figure 3:
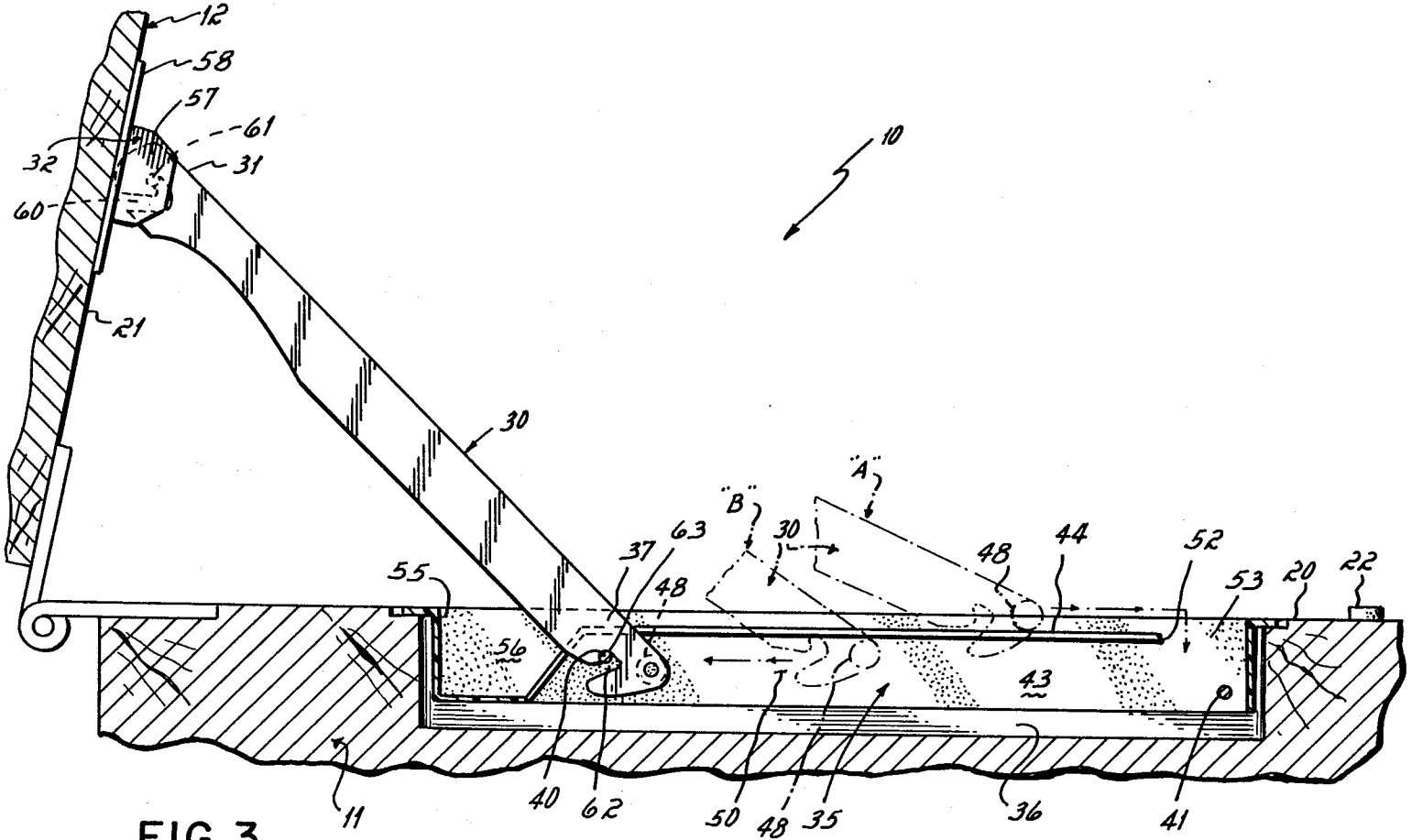
FIG. 3 is an elevational view partly in section of the brace of the present invention.

Referring now to FIGS. 2 and 3, the plastic insert 35 is elongated, being about 7½ inches long. It is secured in the wall of the casket body by a rear transverse nail 40 and a front transverse nail 41 both driven into the wall of the body.

The channel has opposed walls 43. Opposed flanges 44 are molded integrally with the walls 43, the flanges being separated by about 1/16 inch to present a slot 42 through which the slidable end 37 of the brace 30 can slide. The slidable or body end 37 of the brace 30 has a hole 46. A follower 47 consisting of a disk 48 and pin 49 is mounted on the end of the brace by inserting the pin 49 through the hole 46. The lateral dimension of the follower 47 is substantially greater than the width of the slot created by the opposed edges of the flanges 44. Therefore, when the follower is underneath the flanges 44 in the inner section or raceway 50 created by the flanges, the follower prevents the end 37 of the brace from inadvertently snapping out of the channel.

The flanges 44 are discontinued at their front ends 52 to create an opening 53 through which the follower can pass upon installation.

At the rear end of the channel, indicated at 55, a recess 56 is provided. The recess 56 is configurated to receive opposed walls 57 projecting from the bracket 32. The opposed walls are mounted on a thin base 58 which is screwed onto the edge 21 of the cap 12. When the cap is closed, the thin base 58 provides no interference since the bumpers 22 around the perimeter of the casket body maintain the cap and body finished edges spaced slightly from one another to eliminated damage as well as rattling in the transportation.

The cap end of the brace 30 has a J-shaped slot 60 that receives a transverse pin 61 between walls 57 formed integrally with the bracket 32. The body end 37 of the brace has a hook-shaped slot 62. Slot 62 is J-shaped, providing a notch 63 into which rear nail 40 seats.

In the assembly of the brace, the slot 36 is routed in the upper edge 20 of the body 11. A plastic channel 35, previously molded, is inserted in the slot 36. Nails 40 and 41 are driven partially through the body wall a sufficient distance to pass all the way through the channel 35 to secure the channel in position. The rearward nail or keeper 40 forms a pin that receives the hook 62 on the slidable end of the brace 30 to latch the brace and to hold the cap in a raised position.

The cap end 31 of the brace 30 is hooked onto the bracket 57. A follower button 47 is fitted onto the hole 46 in the body end of the brace 30. The cap is pivoted toward a closed position with the follower 47 sliding along the upper surface of the flanges 44 (see phantom line A of FIG. 3). When the follower passes the ends 52 of the flanges 44, it drops through the opening 53. Then, as the cap is swung to an open position, the body end 37 of the brace 30 slides under the flanges 44 and is prevented from escaping the channel by the interference of the flanges (see phantom line B of FIG. 3). The button cannot escape from the hole in the brace because of the width of the channel.

When the cap is opened fully, the hook engages the nail 40 and the nail latches in the notch 63 of the hook 62 in the end 37 of the brace. To relieve the latch to close the cap, the cap is swung slightly rearwardly to disengage the nail 40 from the notch 63. Then the brace is held upwardly while the cap is moved toward a closed position so that the nail rides out of the hook 62 permitting the brace to slide along the channel to a closed position. In the closed position, the bracket walls 57 nest in the recess 56 in the rear end of the channel so that the lid can be completely closed.

It can be seen that the brace presents no interference whatsoever with the upholstery and headliner. It has a very neat appearance that could not be said for the knee brace used in the past. The brace admits of further automation of the manufacture in that there is no fitting of the brace around the headliner and the fitting of the upholstery around the brace.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. In a wood casket body having a top edge and a cap pivoted to a casket body and adapted to close upon said top edge, a brace between casket body and cap to hold said cap open, said brace comprising:

an elongated channel slot in the top edge of said casket body;

an elongated channel inserted in said slot, a keeper projecting through said channel adjacent said lid, an elongated one-piece rigid brace pivotally mounted at one end to said lid, said brace having a body end, the body end of said brace being slidable in said channel and having a notch engageable with said keeper to hold said body end at said keeper and thus to hold said lid in a raised attitude.

2. In a wood casket body having a top edge and a cap pivoted to a casket body and adapted to close upon said top edge, a brace between casket body and cap to hold said cap open, said brace comprising:

a channel slot in the top edge of said casket body, a channel inserted in said slot, a keeper projecting through said channel adjacent said lid, an elongated brace pivotally mounted at one end to said lid, said brace having a body end, the body end of said brace being slidable in said channel and having a notch engageable with said keeper to hold said body end at said keeper and thus to hold said lid in a raised attitude, at least one longitudinal flange in said channel dividing said channel into inner and outer sections, said body end of said brace having a laterally-projecting follower which is captured under said flange to hold the body end of said brace in said channel.

3. A brace as in claim 2, said follower being a disk having a central pin, said body end of said brace having a hole that receives said pin, said channel having a width that confines said follower to said body end of said brace when the casket end of said brace is inserted in said channel.

4. In a wood casket body having a top edge and a cap pivoted to a casket body and adapted to close upon said top edge, a brace between casket body and cap to hold said cap open, said brace comprising:

a channel slot in the top edge of said casket body, a channel inserted in said slot, a keeper projecting through said channel adjacent said lid, an elongated brace pivotally mounted at one end to said lid, said brace having a body end, the body end of said brace being slidable in said channel and having a notch engageable with said keeper to hold said body end at said keeper and thus to hold said lid in a raised attitude, a bracket mounted on said cap, said one end of said brace being pivoted to said bracket, said channel having a cavity adapted to receive said bracket when said cap is closed upon said casket.

* * * * *